United States Patent [19]

Powers et al.

[11] Patent Number: 4,872,392

[45] Date of Patent: Oct. 10, 1989

[54] FIREARM GAS RELIEF MECHANISM

[75] Inventors: Thomas P. Powers, Herkimer, N.Y.; Earl E. Seppala, Hockessin; James C. Young, Newark, both of Del.

[73] Assignee: Remington Arms Company, Wilmington, Del.

[21] Appl. No.: 142,574

[22] Filed: Jan. 11, 1988

Related U.S. Application Data

[63] Continuation-in-part of Ser. No. 106,659, Oct. 13, 1987, abandoned, which is a continuation-in-part of Ser. No. 833,591, Feb. 27, 1986, abandoned.

[51] Int. Cl.[4] ..... F41D 5/08

[52] U.S. Cl. ..... 89/193; 137/512.15

[58] Field of Search ..... 89/191.02, 193; 137/512.15, 855, 856

[56] References Cited

U.S. PATENT DOCUMENTS 3,911,546 10/1975 Schrock et al. ..... 137/512.15

FOREIGN PATENT DOCUMENTS 622826 7/1961 Italy ..... 89/193

*Primary Examiner*—Stephen C. Bentley

*Attorney, Agent, or Firm*—Donald W. Huntley

[57] ABSTRACT

Auto loading gas operated firearm capable of handling a variety of ammunition loads having one or more gas relief valves for the initial volume of the gas cylinder of the firearm, the valves having a leaf spring covering the gas apertures to control the flow of gas from the initial volume of the gas cylinder, and a shaped geometric body interposed between the spring and each aperture that interacts with the spring and aperture to form a seal footprint which is a circular line or ring, the spring preferably operating in a plane substantially perpendicular to the recoil axis of the firearm.

6 Claims, 9 Drawing Sheets

FIREARM GAS RELIEF MECHANISM

CROSS-REFERENCE TO RELATED APPLICATION

This is a Continuation-in-Part of copending application Ser. No. 106,659, filed Oct. 13, 1987, now which was a Continuation-in-Part of copending application Ser. No. 833,591, filed Feb. 27, 1986, and now abandoned.

BACKGROUND OF THE INVENTION

Gas operated auto loading firearms, and particularly shotguns, typically comprise a gas cylinder parallel to the barrel of the gun. A bleed orifice extends from the barrel into the initial volume of the gas cylinder, to permit the pressurized gas resulting from the shot being discharged to pass from the barrel into the gas cylinder. The pressurized gas acts upon a mechanism which operated to replace spent shells with live shells from a magazine tube and cock the hammer of the shotgun for the next shot. For most gauges of shotgun, two or more ammunition loads are generally available. A light ammunition load is typically used for target practice, with increasingly heavy charges found in field loads and magnum loads.

In the past, different barrel and inertia sleeve assemblies have been used to accommodate the different ammunition loads, and effort has been directed toward the development of a firearm that would satisfactorily accommodate all of the readily available ammunition loads without modification of the mechanism or shooter adjustments.

SUMMARY OF THE INVENTION

The present invention provides an improved firearm mechanism which permits the use of target loads, field loads, and magnum loads without modification of the mechanism.

Specifically, the present invention provides, in an automatic firearm having a barrel, a gas cylinder with an initial volume at one end, a piston at one end of the initial volume within the gas cylinder to actuate mechanism for replacing spent ammunition and cocking the firearm, and a bleed orifice connecting the barrel with the initial volume of the gas cylinder, the improvement which comprises at least one gas aperture connecting the initial volume of the gas cylinder with the atmosphere, a leaf spring positioned over the atmospheric side of the aperture to control the flow of gas therefrom, and a shaped geometric body interposed between the aperture and the leaf spring, the shaped geometric body being a body of revolution about a centerline aligned with the aperture, the body interacting with the spring and aperture to form a seal which is a circular line or ring.

Preferably, the aperture and the spring are positioned so that the spring operates in a plane substantially perpendicular to the recoil axis of the firearm.

In a particularly preferred embodiment of the present invention, the improvement comprises two substantially radial apertures formed in the upper half of the gas cylinder connecting the initial volume of the gas cylinder with the atmosphere, hollow conical bodies surrounding the apertures on their atmospheric side, and a C-shaped flat spring encircling a major portion of the gas cylinder, the ends of the spring being positioned over the two apertures to make a sealing contact with the conical bodies and a retaining collar around the spring, the collar being positioned to restrain axial movement and limit radial movement of the spring.

DETAILED DESCRIPTION OF THE INVENTION

Figure 1:
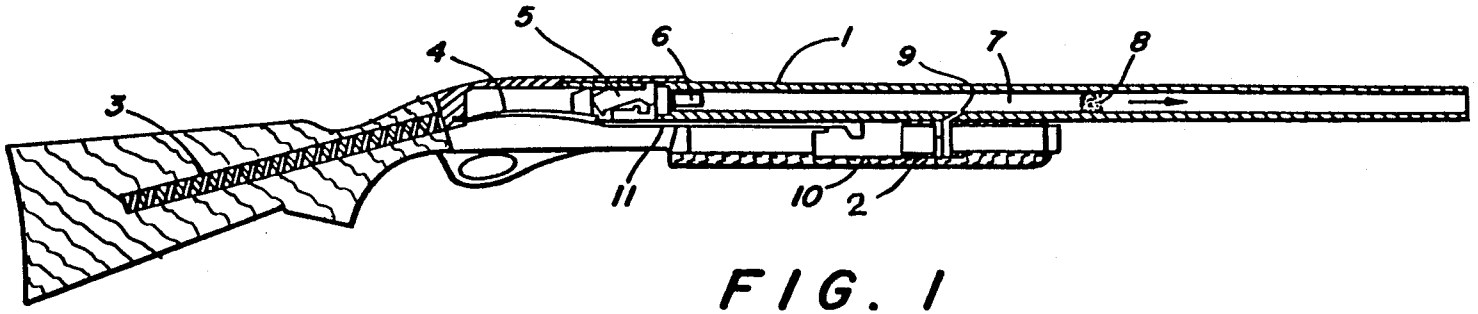
FIG. 1 is a phantom view of the major components of an autoloading shotgun.

The major components of a gas-operated auto loading shotgun are shown in FIG. 1, which is a phantom view of the shotgun assembly. In that figure, barrel 1 is operated in association with gas cylinder 2. Action spring 3 is connected through link 4 to return the bolt mechanism at position 5 to prepare to discharge ammunition load 6. The discharge of the shell generates pressurized gas 7 propelling shot column 8 down the barrel. The pressurized gas, in part, passes through bleed orifice 9 into the initial volume of the gas cylinder, actuating the inertia sleeve 10 and action bar 11 to complete the operation of shell replacement and recocking. The cocking mechanism is omitted for clarity.

Figure 2:
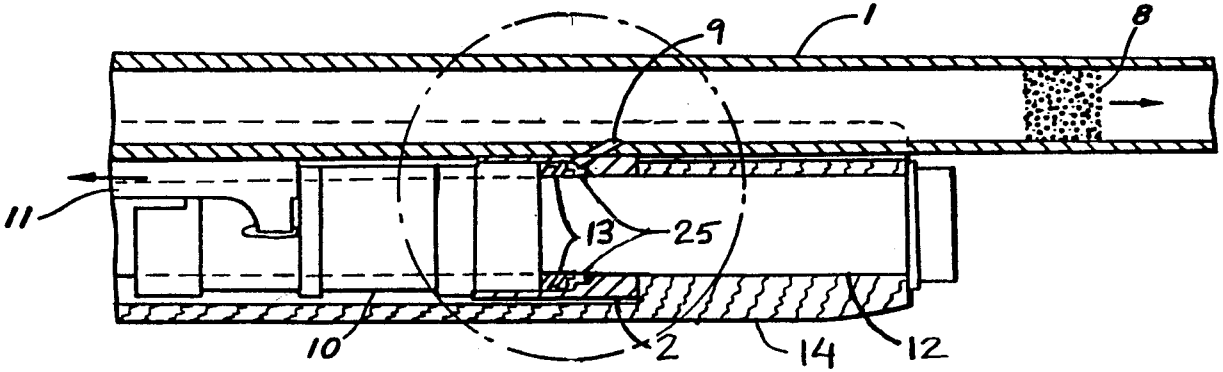
FIG. 2 is an enlarged view of one section of the shotgun of FIG. 1.

Details of the assembly are more readily apparent in FIG. 2, which is an enlarged section of a portion of FIG. 1 which shows the connection between the gas cylinder and the barrel. In that figure, the gas cylinder 2 is shown to be positioned around magazine tube 12. The gas entering from the bleed orifice 9 enters the initial annular volume 25 of the cylinder and acts on the annular piston and seal assembly 13 which seals one end of the gas cylinder.

Figure 4:
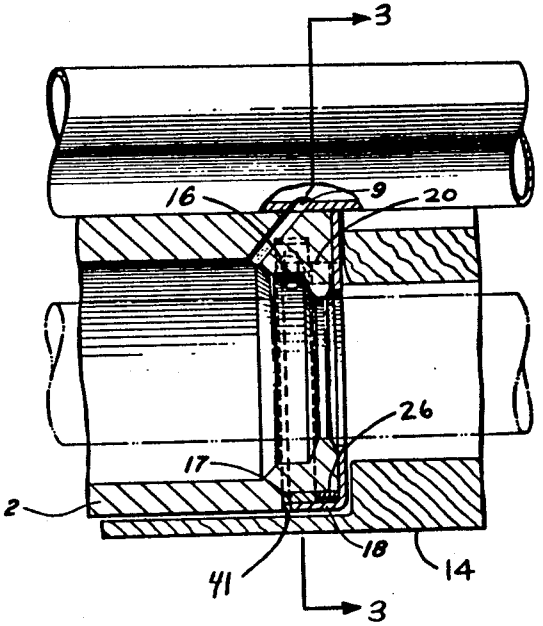
FIG. 4 is an enlarged side view of a portion of the shotgun of FIG. 2, with the relief valve of the present invention added.
Figure 3:
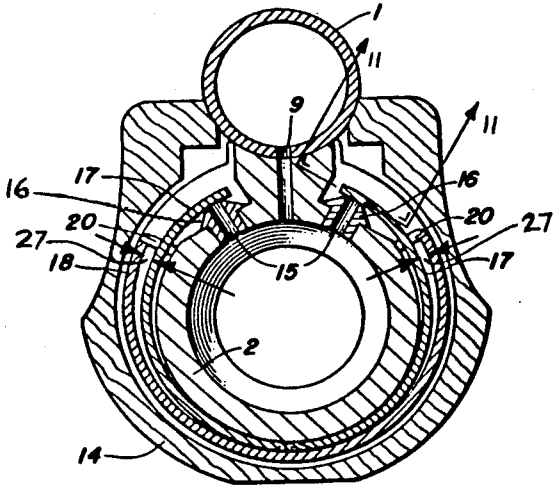
FIG. 3 is a cross-sectional view of an embodiment of the present invention.
Figure 11:
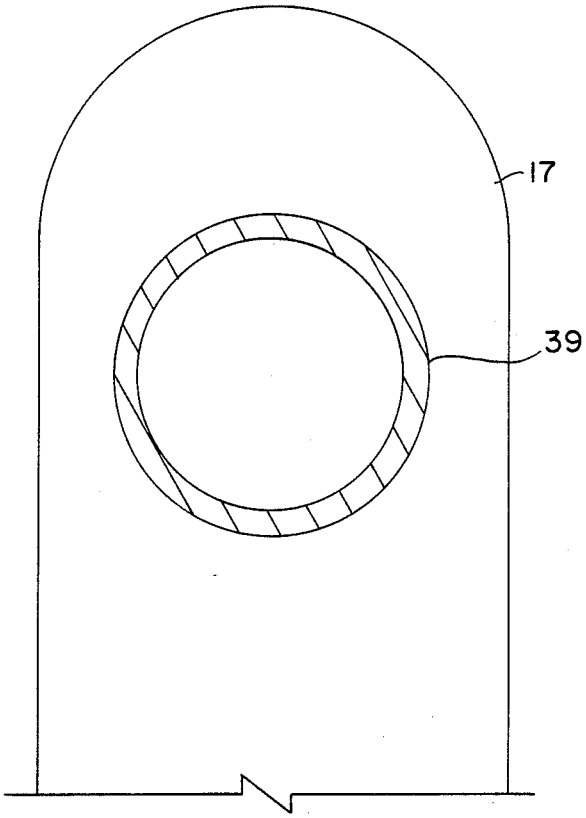
FIG. 11 is a view taken along 11—11 of FIG. 3 showing the circular line seal.

The preferred relief valves of the present invention are shown in FIGS. 3 and 4, FIG. 4 being an enlarged cross-sectional view of the assembly of FIGS. 1 and 2, with the relief valve of the present invention added. In these figures, the gas relief mechanism of the present invention is shown, as well as fore-end 14. The relief mechanism consists of apertures 15, here shown with valve seat inserts 16 which can be formed of metal such as heat-treated steel. The size of the two apertures will necessarily vary with the shotgun size, but are typically about ⅛ inch in diameter. The inserts 16 provide hollow conically shaped geometric bodies interposed between the apertures 15 and springs ends 17 to present a sharp circular line seal surface. The bodies, instead of being inserts, can alternatively be cold formed or machined in the outer surface of the material of the gas cylinder. In any event, the bodies in this embodiment are integral with the aperture. C-shaped cantilever spring 17 is positioned so that its end portions seal against the valve inserts thereby forming a seal which is a circular line or ring. FIG. 11 illustrates this seal footprint 39 on the spring surface that contacts the hollow conical insert. The narrow ring is important in that it provides minimum area for debris to collect on and the minimum area results in high unit loading (pounds per square inch) that tends to squeeze debris out of the sealing area. In other words, it is difficult for debris to collect on a knife edge. The width of the footprint should generally be less than about 1/32 inch.

Figure 10:
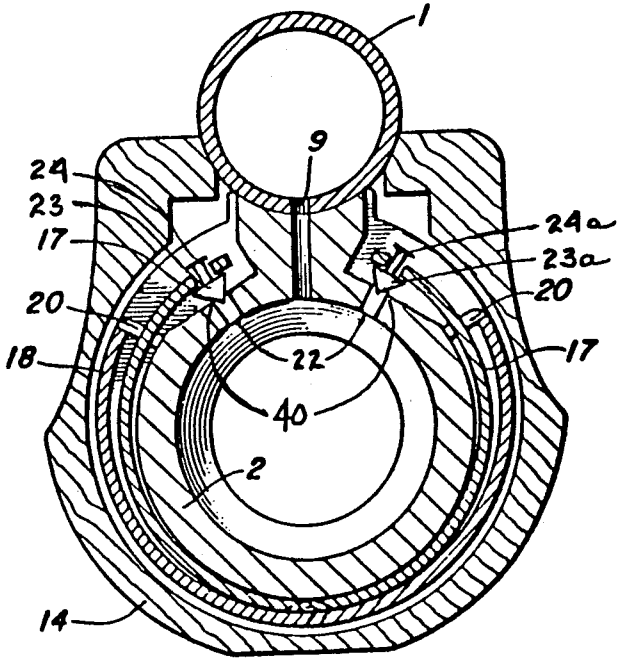
FIG. 10 is a cross-sectional view of an alternative embodiment of the shotgun of FIG. 1.

The conically shaped body can alternatively be part of the spring, with the aperture having a flat mating surface. This embodiment of the invention is shown in FIG. 10, in which apertures 22 are formed connecting the initial volume of the gas cylinder with the atmosphere. Conical elements 23 and 23*a* are attached to each end of the spring 17 to form a circular line contact with the circular edge of the aperture. In this illustration, the conical elements are loosely attached by means of rivets 24 and 24*a*. When circular line contact is achieved by insertion of the geometric body into the aperture, it is best to have some compliance between the elements to get good alignment for sealing.

The end of leaf springs 17 are cantilevered over the apertures since the c-shaped spring remains stationary at the bottom of the gas cylinder and the ends of each half of the c-shape are free to deflect due to the gas pressure force from the aperture. It is preferred that the points of contact of the spring be limited to the bottom of the gas cylinder and the two seal surfaces. The cross section of the leaf spring is shown as rectangular, but it can take other forms such as round, "U" shaped, or the like so long as the spring will open at the desired pressure and the sealing ends of the spring are adapted to provide seal footprints each of which provide a circular line contact between the geometric body and the aperture.

A retaining collar 18 is positioned around the spring to axially restrain movement of the spring during recoil and limit radial movement of the spring from the apertures and the bottom of the gas cylinder. The spring should not undergo excessive radial movement that would cause permanent deformation and change the preload on the spring. Axial positioning of the retaining collar is shown in FIG. 4. The piston and seal assembly and other components have been omitted for clarity.

Figure 5:
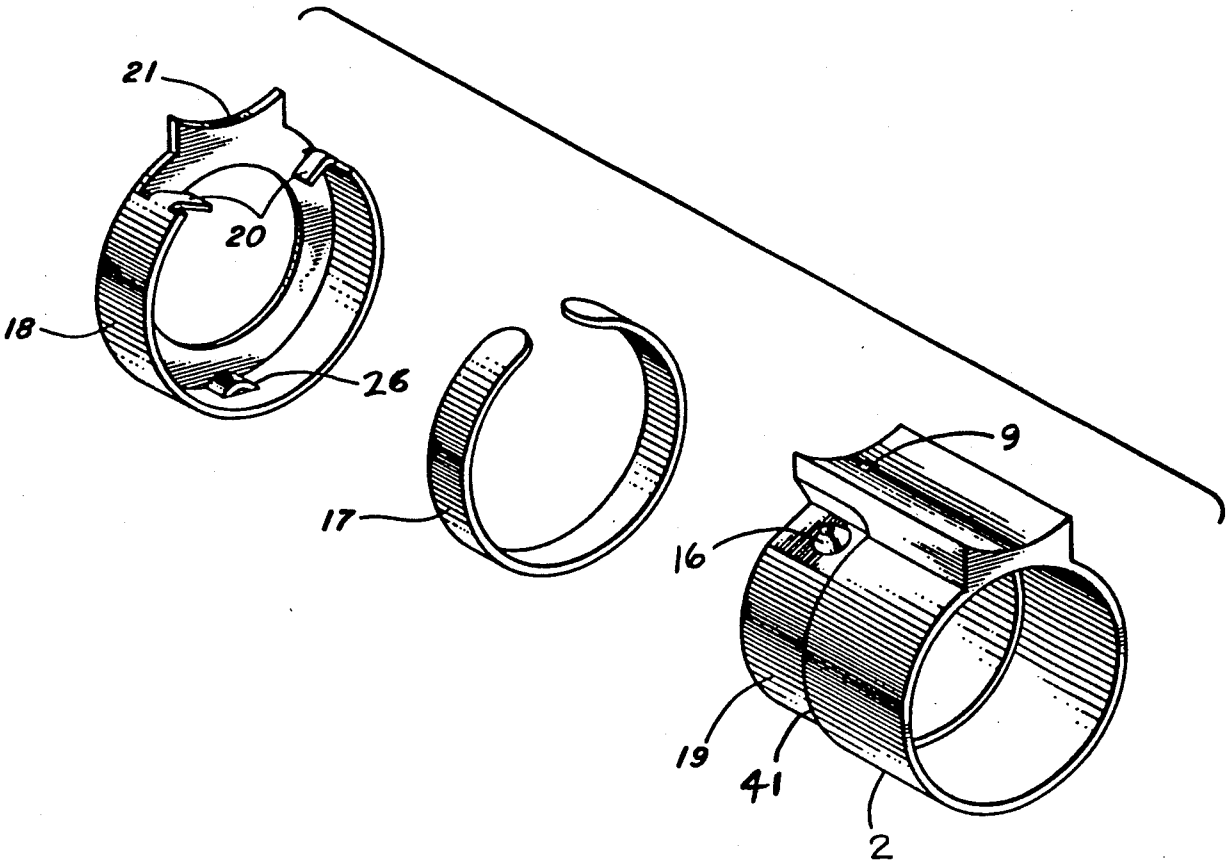
FIG. 5 is an exploded view of the components of a valve and collar that can be used in the present invention.
Figure 7:
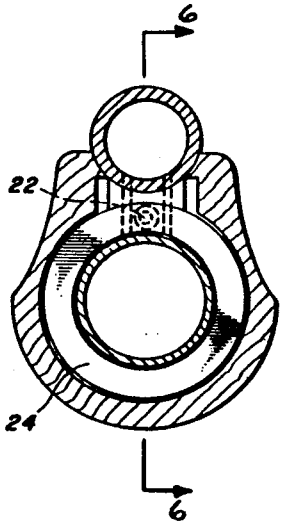
FIG. 7 is a cross-section of the shotgun of FIG. 6, taken at section 7—7 of FIG. 6.

The assembly and components of the present invention are shown in FIG. 5, which is an exploded view of the valve components and the retaining collar. The gas cylinder 2 has a smaller outer diameter at the position of the apertures indicated by area 19. The conically shaped geometric bodies 16 are shown integral with the gas cylinder on a flat portion of area 19. This small outer diameter provides space to contain the spring 17 and collar 18, provide clearance around the spring, and a shoulder 41 to axially locate the spring. The collar 18 can be provided with tabs 20 which are here bent inward from the collar to axially locate the spring and act as standoffs to help radially locate the collar. Indentation 26 at the bottom of the collar provides the same function. A radiused scallop 21 is formed on the collar concentric with the barrel diameter to prevent collar rotation.

The spacing 27 (FIG. 3) of the collar from the ends of the spring should be such as to provide a maximum movement of the spring, in operation, of about 0.010 to 0.100 inch. A C-shaped spring can be used made from AISI 6150 spring steel flat stock and having a thickness of about 0.037 inch, a width of about ¼ inch, and a preload against each insert of about 6–12 pounds, depending on the aperture size used. A preload of about 8 pounds is typically used for an aperture size of about ⅛ inch. The pressure in the gas cylinder from a light target load will be insufficient to overcome the force of the spring, and the apertures will remain closed. In this situation, the full pressure coming through the gas bleed orifice will accelerate the inertia sleeve and its connected elements. By contrast, when a magnum load is fired, the pressure through the bleed orifice into the initial gas cylinder volume will exceed the force of the spring, venting excess pressure through the apertures to the atmosphere and into the space inside the fore-end.

Figure 6:
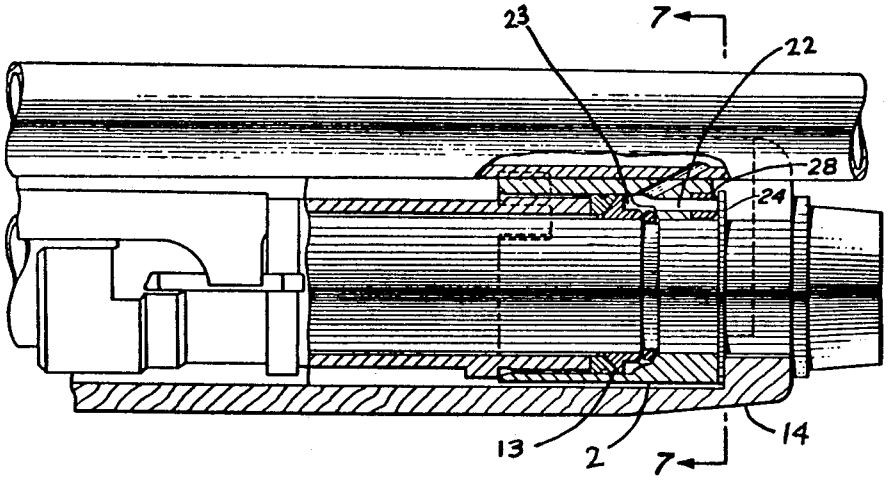
FIG. 6 is a partial cross-sectional view of a shotgun showing another embodiment of the present invention.

Another embodiment of the present invention is shown in FIG. 6, in which one or more apertures 22, extend from the initial volume 23 of the gas cylinder to the atmosphere. The aperture has a conically shaped geometric body 28 surrounding it. A leaf spring 24 (shown not sectioned) is positioned over the atmospheric end of the aperture, the spring being of substantially circular configuration and clamped at a position substantially 180 degrees from the aperture between fore-end 14 and gas cylinder 2. The leaf spring seals the aperture by interacting with the interposed body 28 thereby forming a seal footprint which is a circular line or ring.

Figure 12:
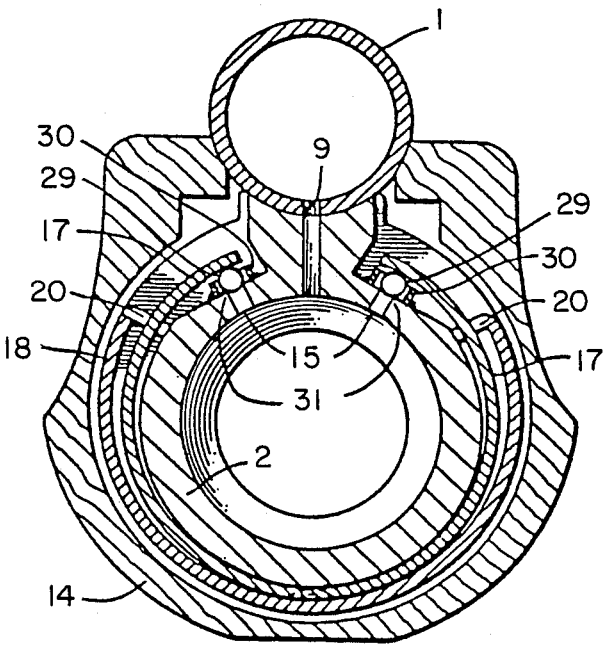
FIG. 12 is a variation of the view of FIG. 3 showing an alternate embodiment of the relief valve.

A variety of other geometric shapes can be used in the present invention. For example, FIG. 12 shows a view similar to FIG. 3 of an arrangement where a spherical ball 29 is freely moveable within cage 30 surrounding apertures 15. The ends of leaf spring 17 permit limited movement of the ball away from the aperture to relieve excess gas pressure in cylinder 2. When the leaf spring acts to cover the aperture, the interposed ball interacts with the spring and aperture to form a seal the footprint of which is a circular line or ring formed by the edges 31 of apertures 15 and the balls 29. The inventive combination of a simple, cantilever leaf spring, a circular aperture, and a shaped geometrical body interposed between the spring and aperture and interacting with them to form a seal footprint which is a circular line or ring is found in this embodiment.

Figure 13:
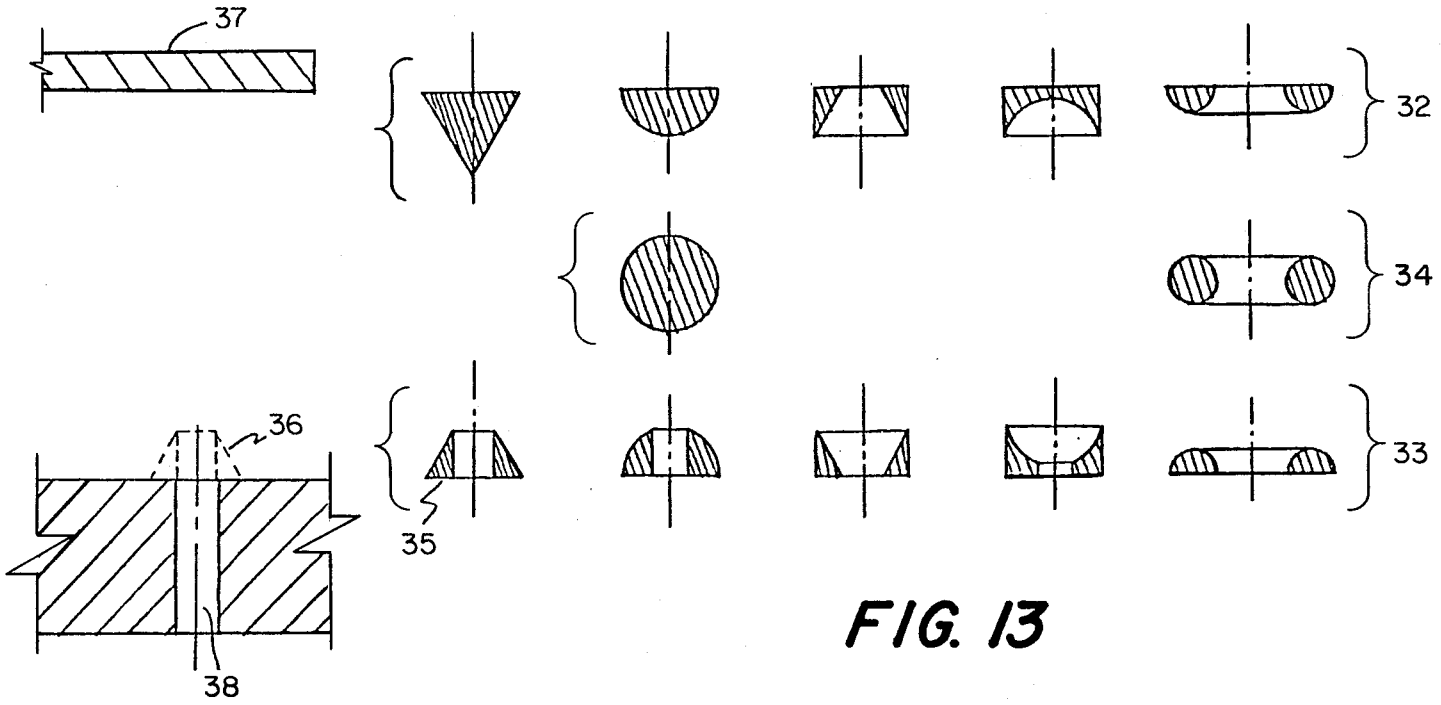
FIG. 13 is a diagram illustrating several alternative geometric bodies useful in the relief valve of the present invention.

FIG. 13 shows several representative alternative embodiments of the present invention. The shaped geometric bodies, of the alternative types designated as 32, can be integral with the leaf spring 37. Alternatively, the shaped geometric bodies, of the representative types designated as 33, can be integral with the aperture 38. In still other embodiments, the geometric shapes, illustrated as 34, can be freely moveable, and not integral with either the spring or the aperture. For instance, in one preferred embodiment, body 35 is integral with the aperture 38 as shown by the dotted lines at 36. The geometric bodies are all characterized by being bodies of revolution around a centerline which in operation is aligned with the circular aperture centerline. Although regular geometries are shown, irregular geometries are equally effective as long as they form the required circular line contact when interacting with the aperture and spring. When the bodies are integral with the leaf spring or are freely moveable, the cross section of the spring may take a variety of cross-sectional shapes, as mentioned, without affecting the sealing operation of the valve.

The leaf springs used in the present invention provide a simple and reliable operation. The moving part of the valve is the leaf spring, the motion of which is substantially friction-free with no closely guided sliding surfaces that are subject to jamming due to dirt and gas residue buildup. The friction-free motion combined with the low mass, and hence low inertia, of the moving spring result in a non-clogging fast acting valve. This permits the valve to relieve the excess gas pressure before it accelerates the auto-loading parts to an unacceptably high velocity. The interposed shaped geometric body creates a circular line sealing edge spaced from adjacent surfaces so debris adjacent the sealing footprint will not affect the quality of the seal and repeatable operation is assured.

The preferred mechanism of the present invention, with its operation perpendicular to the recoil, is substantially unaffected by variations in the recoil velocity that may occur with different shooters and shot-shell loads. As a result, the operation of the valve is unusually consistent predictable. The sealing surface between the preferred spring and the valve insert has a circular line contact that is relatively simple to make, reliable in operation, and not sensitive to residue buildup. As a result, the present mechanism provides low maintenance and the convenience of not having to change or adjust gun components with varying ammunition loads.

EXAMPLE

A shotgun was prepared having a gas relief mechanism substantially as shown in FIGS. 3 through 5. Two relief valves were formed in the upper portion of the gas cylinder. Inerts were prepared from heat-treated steel and silver brazed into the gas cylinder. The inserts provided apertures of about ⅛ inch diameter and were provided with a conical shape to present a 0.005 inch wide circular line surface for contact with the sealing spring. A flat C-shaped spring made from heat-treated AISA 6150 spring steel was loaded against the sharp sealing surface of the inserts. It is preferred that the conically shaped surface of the insert be less hard than the flat mating surface of the spring to achieve good sealing regardless of slight misalignment after wear-in. A collar as shown in FIGS. 3 through 5 was installed to restrain the axial and radial movement of the spring in action.

The shotgun was tested and compared with the same shotgun with the relief mechanism of the present invention clamped shut in which the bolt velocity and bolt displacement were measured. The bolt velocity is proportional to the pressure within the gas cylinder.

Figure 8:
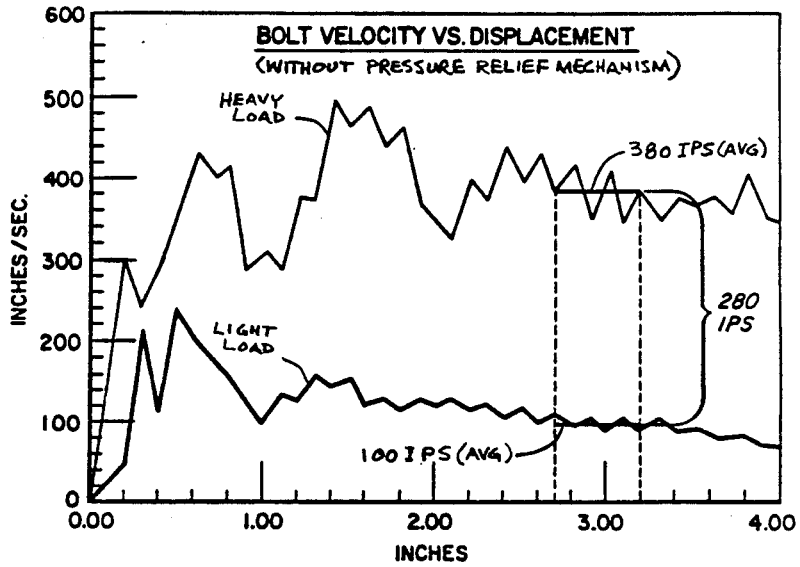
FIGS. 8 and 9 are graphical representations of bolt velocity vs. displacement of a shotgun, with and without the improvement of the present invention.
Figure 9:
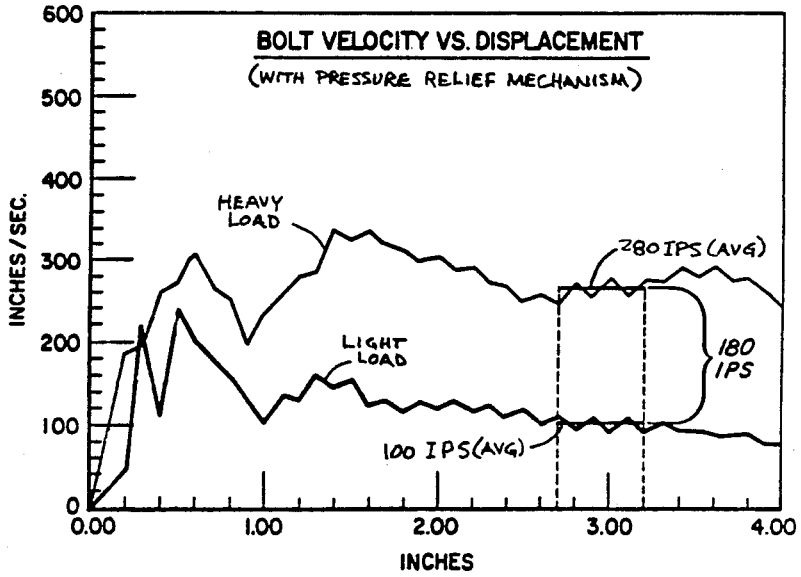

The results of this testing are summarized in FIGS. 8 and 9. Bolt velocity is there plotted on the vertical axis and bolt displacement on the horizontal axis. FIG. 8 demonstrates the firing of a light load and a heavy load shell in the shotgun without utilizing the relief mechanism of the present invention. In the upper curve, resulting from the discharge of the heavy load, the bolt velocity peaks at about 500 inches per second and the average bolt velocity measured after about three inches of bolt displacement and shortly before impact with the receiver is about 380 inches per second. This high velocity during travel and at impact puts unnecessary stress on all of the operating parts of the gun and will result in premature wear and failure. In FIG. 9, demonstrating the operating of the apparatus of the present invention, the same type shells with light and heavy loads were used. With this mechanism, the heavy load velocities are dramatically reduced while the light load velocities remain substantially unchanged. The peak velocity with the heavy load, using the present apparatus, is about 340 inches per second and the average velocity shortly before impact is only about 280 inches per second. By comparing the curves in FIGS. 8 and 9, it is-apparent that the pressure relief mechanism opens and vents gas when firing the heavy loads, but remains closed without venting when firing light loads.

We claim:

1. In an automatic firearm having a barrel, a gas cylinder with an initial volume at one end, a piston at one end of the initial volume within the gas cylinder to actuate mechanism for replacing spent ammunition and cocking the firearm, and a bleed orifice connecting the barrel with the initial volume of the gas cylinder, the improvement which comprises at least one gas aperture connecting the initial volume of the gas cylinder with the atmosphere, a leaf spring positioned over the atmospheric side of the aperture to control the flow of gas therefrom, and a shaped geometric body interposed between the aperture and the leaf spring, the shaped geometric body being a body of revolution about a centerline aligned with the aperture, the body interacting with the spring and aperture to form a seal which is a circular line or ring, and wherein the spring is oriented to move in a direction perpendicular to the direction of recoil during the operation to control the flow of gas.

2. A firearm of claim 1 wherein the shaped geometric body is integral with the aperture.

3. A firearm of claim 1 comprising two substantially radial apertures formed in the upper half of the gas cylinder and a C-shaped spring encircling a major portion of the gas cylinder, the ends of the spring being positioned over the two apertures.

4. A firearm of claim 3 further comprising a retaining collar around the spring, the collar being positioned to axially restrain movement of the spring and limit radial movement of the spring from the apertures.

5. A firearm of claim 4 wherein the collar is positioned to limit radial movement of the ends of the spring to about from 0.010 to 0.100 inch.

6. A firearm of claim 1 wherein the shaped geometric body is conical.

* * * * *